United States Patent [19]

Purdie, deceased

[11] 4,425,833

[45] Jan. 17, 1984

[54] CARTRIDGE CASE HOLDER APPARATUS

[75] Inventor: Clarence E. Purdie, deceased, late of Faribault, Minn., by Irene D. Purdie, executor

[73] Assignee: Gopher Shooter's Supply Company, Incorporated, Faribault, Minn.

[21] Appl. No.: 412,157

[22] Filed: Aug. 27, 1982

[51] Int. Cl.[3] ..... F42B 33/00; F42B 35/02

[52] U.S. Cl. ..... 86/44; 86/26; 86/45; 86/46

[58] Field of Search ..... 86/44, 20 R, 23, 26, 86/45, 46

[56] References Cited

U.S. PATENT DOCUMENTS

| | | | |
|---|---|---|---|
| 3,107,575 | 10/1963 | Paul | 86/44 |
| 3,185,019 | 5/1965 | Shoffstall | 86/44 |
| 3,319,511 | 5/1967 | McLean | 86/44 |

*Primary Examiner*—Leland A. Sebastian
*Assistant Examiner*—Joel P. Okamoto
*Attorney, Agent, or Firm*—Clayton R. Johnson

[57] ABSTRACT

Apparatus for holding a cartridge case during a reloading operation that includes a jaw holder having a first groove extending linearly thereacross, second and third grooves intersecting the first groove at right angles and extending away therefrom in opposite directions and a bore opening to the first groove and centered relative the grooves for having a primer moved therethrough, three elongated jaws having elongated slots, each jaw having a lip at each of its longitudinally opposite ends, and screws extended through the jaw slots and threaded into the jaw holder to permit adjusting the jaws in the grooves relative the bore and retain the jaws in the adjusted positions. Two jaws are mounted in the first groove on diametrically opposite sides of the bore, the third jaw is mounted in the third groove and the second groove is provided for translating a cartridge case to have the lips of the three jaws extend into the case cannelure.

In the first embodiment, the jaw holder is a plate mountable on other structure, for example a conventional loading press while in the second embodiment the jaw holder is a portion of a primer seater.

7 Claims, 7 Drawing Figures

CARTRIDGE CASE HOLDER APPARATUS

BACKGROUND OF THE INVENTION

A cartridge reloading tool for holding a cartridge case during a cartridge reloading operation.

In U.S. Pat. No. 3,319,511 to McLean, there is disclosed a cartridge holder having an upper portion with three recesses on one side for mounting cartridge clamping fingers for slidable movement and a recess on the opposite side thereof for the cartridge rim being slid through to a position to be clamped by the fingers, and a cam ring for adjustably positioning the fingers. U.S. Pat. No. 3,107,575 to Paul discloses a shell holder jig having three grooves on the same side of the body, two of the grooves mounting jaws to be resiliently urged toward one another, and the third groove being a feed groove for a cartridge case being moved between the jaws. U.S. Pat. No. 3,345,903 to Purdie discloses cartridge case holding jaws that are resiliently urged toward one another, said jaws being provided with elongated slots to have screws extended therethrough. Further, it is old to provide a primer seater having a planar vertical surface with a plunger bore opening thereto, a vertical primer supply tube having a lower end opening to the plunger bore, and three eccentrics held in fixed adjusted positions against the planar surface by screws for holding a cartridge case with one eccentric being at a lower elevation than the plunger bore and the other two being on transverse opposite sides of and forwardly of the bore.

In order to make improvements in cartridge case holder apparatus for holding a cartridge case during a reloading operation, this invention has been made.

SUMMARY OF INVENTION

Cartridge case holder apparatus that includes a jaw mount having a first elongated groove and a pair of transverse grooves on opposite sides of the first groove and opening thereto, a pair of jaws mounted in the first groove for adjustable slidable movement and a jaw mounted in one of the transverse grooves, the other transverse groove being a cartridge feed groove, each of the jaws having an elongated slot extending therethrough, and a screw for each jaw extended through the respective slot that is threaded into the jaw mount and tightened to hold the jaw in an adjusted position whereby the jaws are retained in positions for holding a cartridge case to have a work operation performed thereon.

An object of this invention is to provide a new and novel means for holding a cartridge case during a reloading operation. A further object of this invention is to provide a new and novel cartridge case holder that is easily adjustable to accommodate variables in different makes of cartridges and once adjusted, will maintain its adjusted condition until readjusted.

BRIEF DESCRIPTION OF THE DRAWINGS

Referring now to FIGS. 1–4, the first embodiment of the cartridge case holder of this invention, generally designated 10, is shown in FIG. 1 as being mounted on a loading press, generally designated 11. The holder 10 includes a jaw mount 12 in the form of a rectangular plate having a first groove 13 extending longitudinally thereacross. Longitudinally aligned transverse second and third grooves 14 and 15 open to transverse opposite sides of the groove 13 and extend away therefrom at right angles to groove 13. Each of the grooves is of the same depth D while the longitudinal dimension L of each of the transverse grooves is the same as the transverse dimension T of the longitudinal groove. The inner (bottom) walls that in part define the grooves are coplanar while the side walls that in part define the grooves are perpendicular to the bottom walls.

Figure 1:
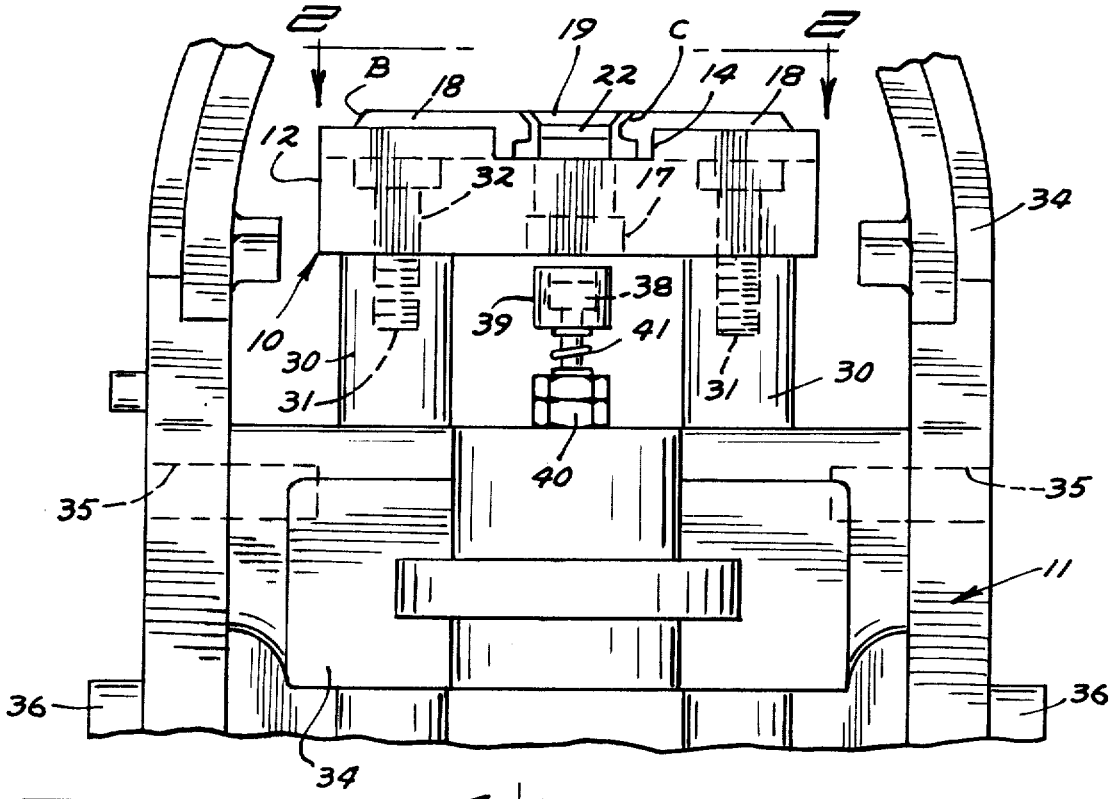
FIG. 1 is a fragmentary front view of a conventional loading press having the first embodiment of the cartridge case holder aparatus of this invention mounted thereon.
Figure 2:
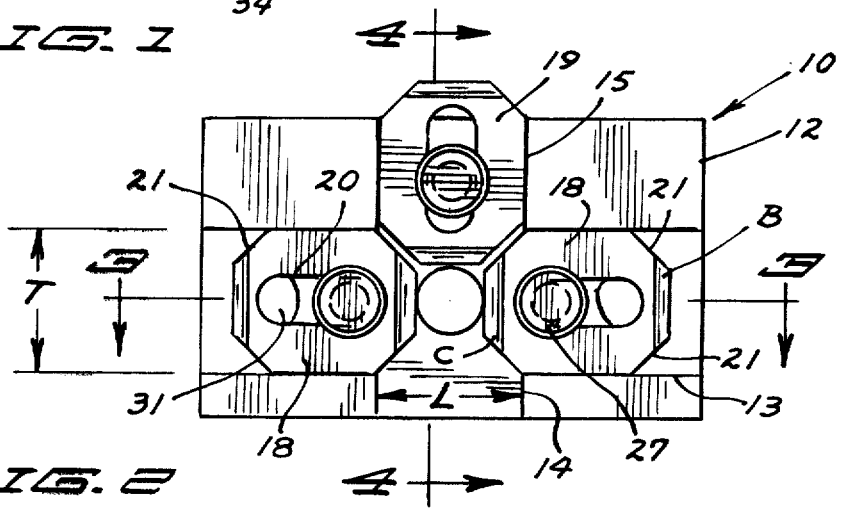
FIG. 2 is a plan view of the cartridge case holder of FIG. 1 that is generally taken along the line and in the direction of the arrows 2—2 of FIG. 1.
Figure 3:
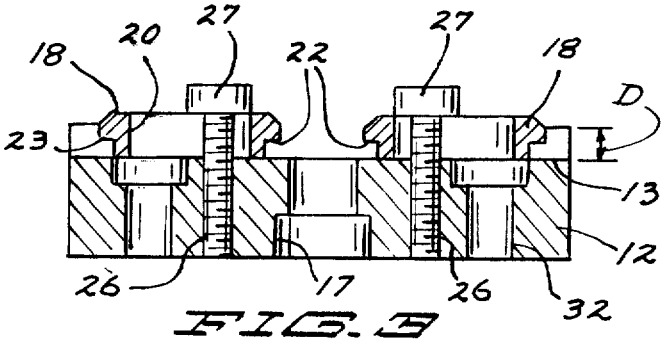
FIG. 3 is a longitudinal cross sectional view generally taken along the line and in the direction of the arrows 3—3 of FIG. 2.
Figure 4:
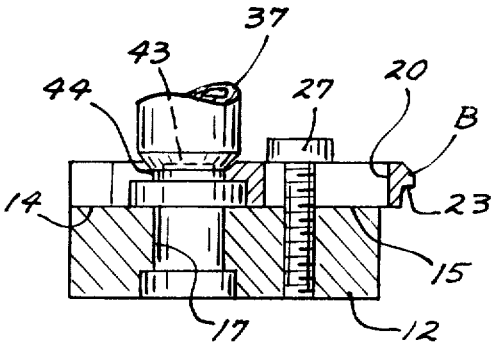
FIG. 4 is a transverse cross sectional view generally taken along the line and in the direction of the arrows 4—4 of FIG. 2, said view also showing a portion of a cartridge case in a position for having a primer seated therein.

Extending through the jaw mount to have one axial end open through the bottom surface of the longitudinal groove in centered relationship to the transverse grooves is a bore 17. The central axis of the bore is perpendicular to the bottom surfaces of the grooves while the diameter of the opening of the bore to bottom surface is less than dimension T.

Mounted in the groove 13 on longitudinally diametric opposite sides of the bore 17 is a jaw 18 while mounted in the groove 15 is a jaw 19. No jaw or other structure is mounted in groove 14, groove 14 being a cartridge case feed groove.

Each of the jaws is of the same size and shape. Further, each of the jaws has parallel, planar top and bottom surfaces that are spaced by a dimension D; elongated, parallel, planar side surfaces of a spacing to form a close sliding fit with the sidewalls of the respective groove; a slot 20 elongated in the direction of elongation of jaw side surfaces and opening through the jaw top and bottom surfaces; diagonally cut corners 21, for example about a 45° angle; a cut-out 22 extending between the corners 21 at one end of the jaw that in conjunction with a beveled top surface C provides a first lip; and a cut out 23 extending between the corners 21 at the other end of the jaw that in conjunction with a beveled top surface B provides a second cut-out. The vertical walls that in part define the cut-outs 22, 23 of each jaw extend parallel to one another and perpendicular to the direction of elongation of the jaw, the height of the vertical wall of one of the cut-outs being greater than the height of the other. The horizontal walls that in part define the cut-outs 22, 23 of each jaw are planar to the bottom surface of the respective groove to provide downwardly facing shoulders that are of different vertical spacing from the bottom surface for accommodating different cartridge case rim thicknesses.

On longitudinally opposite sides of bore 17 to open to the bottom surface of groove 13 there is provided a threaded aperture 26 for having a socket head screw 27 extended through the slot 20 of the respective jaw and threaded into said aperture. Likewise there is provided a threaded aperture 26 opening to the bottom surface of groove 15 for having a socket screw 27 extended through the slot of jaw 19 and threaded into said aperture. The apertures 26 are equally radially spaced from bore 17.

The jaw mount of the first embodiment has two spaced counter bore apertures 32 that open through the bottom surface of groove 13 for having socket screws 31 extended therethrough and threaded into the upper ends of guide rods 30 of the loading press 11 for mounting the first embodiment to move with the guide rods. The guide rods are vertically slidably mounted by the head 33 of a generally C-shaped frame, only the upper portion of the frame being shown in the drawings. A handle 34 (only bifurcated leg portions shown) is pivotally mounted at 35 to the head and pivotally mounts the upper ends of links 36 which in turn are pivotally connected to the carrier (not shown) that is fixed to the guide rods to vertically move the guide rods as the handle is pivoted about pivots 35. The loading press had not been illustrated in greater detail nor the construction thereof fully described herein since it is the same as that disclosed in U.S. Pat. No. 3,345,903 other than the first embodiment of the cartridge case holder is mounted on the upper ends of the guide rods instead of the mounting bar, holding plate and cartridge holder disclosed therein. To the extent necessary to understand the manner in which the first embodiment 10 is used, U.S. Pat. No. 3,345,903 is hereby incorporated by reference.

Transversely between the guide rods, the head mounts a primer holder to extend thereabove, the primer holder including a cap head stud 38 having a lower end threaded into the head, and a sleeve 39 slidably mounted on the stud for movement between a position the upper end of the sleeve extends a substantial distance vertically above the top surface of the stud and a position the upper edge of the sleeve is at the same elevation as the top of the stud. The lower end portion of the sleeve is of an inside diameter that is less than the outer diameter of the cap head of the stud while the inner diameter of the upper portion of the sleeve is sufficiently great to have a primer inserted therein. Lock nuts 40 are provided on the stud and a coil spring 41 has one end abutting against the upper lock nut and an opposite end bearing against the sleeve to resiliently retain the sleeve in its uppermost position. The minimum inner diameter of the bore 17 is sufficiently great for having the upper end of the sleeve moved therethrough.

In using the first embodiment, the jaws are positioned in the grooves 13, 15 to have the appropriate ends of the jaws for the rim thickness of the cartridge cases to be primed adjacent bore 17. A gauge may be used for adjusting the jaws so that the primers are seated coaxially in the primer pocket 43 of the cartridge case 37. The jaws are adjusted by loosening the screws 27, moving the jaws radially relative to bore 17, and then the screws tightened to have the head ends thereof bear against the top surfaces of the jaws to hold the jaws in fixed positions relative the jaw mount. By providing diagonal corners 21, the jaws may be positioned closer to bore 17 than if the corners were right angle corners and at the same time the vertical walls that in part define the lips are of dimensions at right angles to the direction of elongation of the jaws that are greater than the diameter of the opening of bore 17 through the bottom surface of groove 13.

Now a cartridge case 37 is moved through groove 14 to have the lips, for example 22, extend into the case exterior groove (cannelure) 44 and abut against the case, and the press handle pivoted to move the first embodiment 10 downwardly so that the sleeve will extend into the bore 17 and abut against the case 37. This is to check to make sure the appropriate adjustments have been made. Once appropriately adjusted and the primer holder below the cartridge case holder 10, a primer is placed in sleeve 39 and the handle pivoted whereby the case moves the sleeve and case downwardly relative the stud and the primer to seat the primer in the case primer pocket 43. Now the handle is pivoted to raise the holder 10 and the cartridge case removed from the holder.

Figure 5:
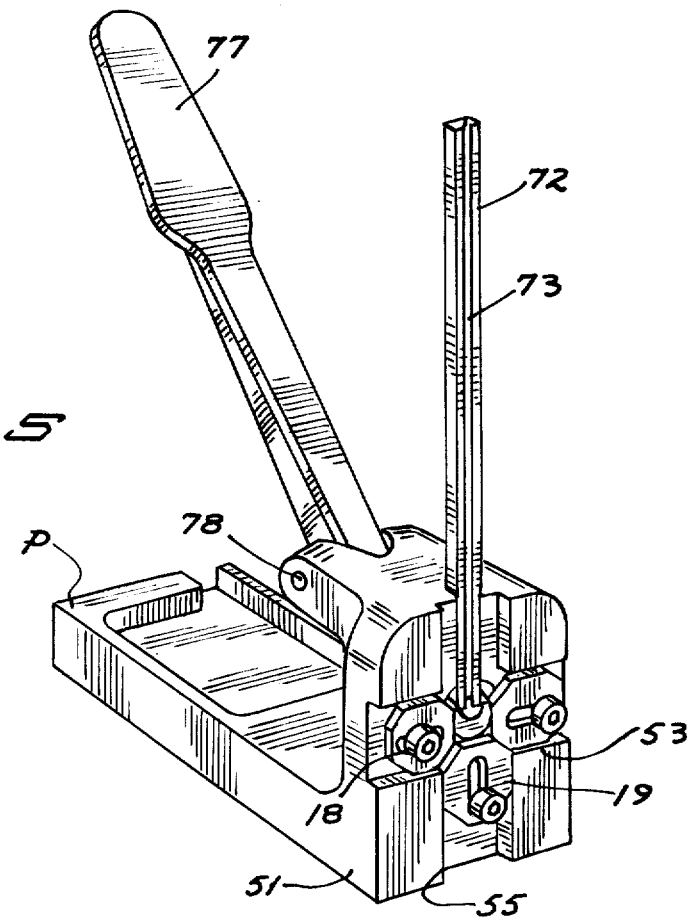
FIG. 5 is a perspective view of a primer seater having the second embodiment of the cartridge case holder apparatus of this invention.
Figure 6:
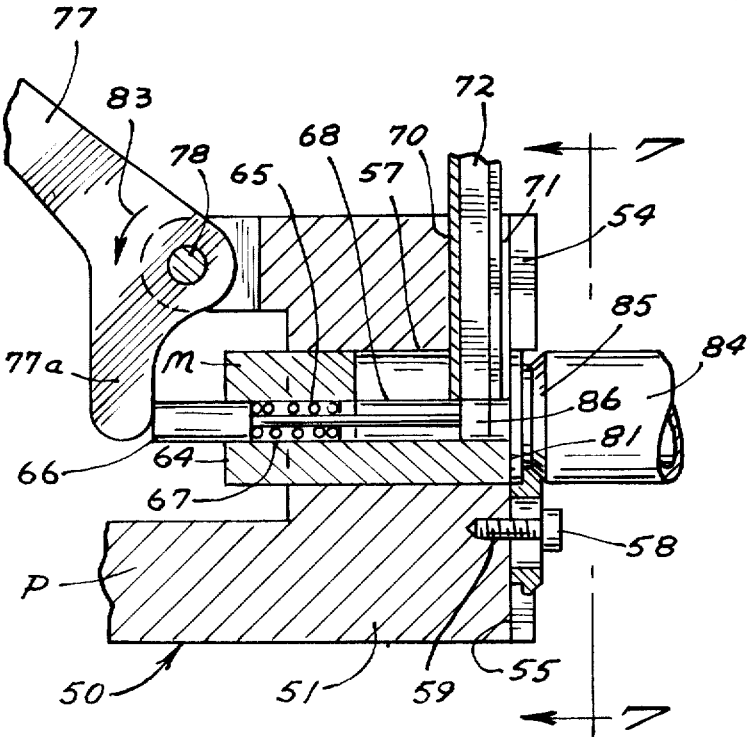
FIG. 6 is a fragmentary vertical cross sectional view of the apparatus of FIG. 5, said view being generally taken along the line and in the direction of the arrows 6—6 of FIG. 7 and additionally showing a portion of a cartridge case in a position for having a primer seated therein.
Figure 7:
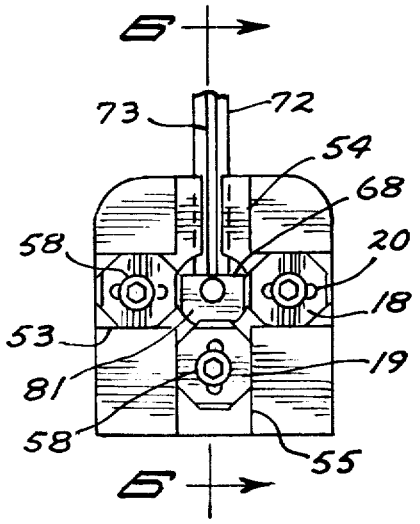
FIG. 7 is a fragmentary front view generally taken along the line and in the direction of the arrows 7—7 of FIG. 6 other than no cartridge case is shown.

Referring now to FIGS. 5–7, the second embodiment of the cartridge case holder of this invention, generally designated 50, will now be described. The second embodiment includes a jaw mount 51 which is the forward end portion of the primer seater base P. The jaw mount 51 has an elongated first groove 53 extending horizontally thereacross intermediate top and bottom surfaces of the mount, and vertical second and third grooves 54, 55 that are aligned, open through the mount top and bottom surfaces respectively, open to opposite sides of the first groove in centered relationship to the side surfaces of the jaw mount and extend at right angles to the first groove. Each of grooves 53–55 is of the same depth while the inner walls that in part define the grooves are coplanar and the side walls that in part define the grooves are perpendicular to the inner walls. Further the side walls of each groove are parallel to one another. Additionally the vertical dimension of groove 53 is the same as the transverse dimension of each of grooves 54, 55.

A cylindrical bore 57 is provided to extend through the jaw holder and open through the inner of the first groove in centered relationship to the second and third grooves. The central axis of bore 57 is perpendicular to the inner walls of the grooves. Mounted in the first groove 53 to extend radially outwardly of the opening of the bore to the first groove are a pair of jaws 18 while mounted in the third groove 55 is a jaw 19. The jaws 18, 19 of the second embodiment are of the same size and shape as those of the first embodiment. A threaded aperture 59 is provided in the jaw mount to open to the third groove while a pair of the threaded apertures (not shown) corresponding to aperture 59 is provided to open to the first groove on diametric opposite sides of bore 57. These aperture are equally radially spaced from the bore and threadedly receive screws 58 that extend through slots 20 of the jaws to retain the jaws in adjusted positions in the respective groove.

A plunger mount M is extended into bore 57 and has a circular cylindrical back portion 64 that is retained in an adjusted axial position in the bore 57 by a set screw (not shown) that is threaded into the jaw mount. A plunger bore 65 extends axially through the plunger mount and has a plunger 66 therein. A coil spring 67 is provided on the reduced diameter front part of the plunger and at one end abuts against a shoulder provided by the reduced diameter plunger bore intermediate part and at the opposite end against the larger diameter plunger rear portion to resiliently urge the plunger rearwardly. The enlarged diametric parts of the plunger and plunger bore are of diameters to form a close sliding fit. Forwardly of the plunger bore reduced diameter portion the upper front cylindrical portion of the plunger mount is cut away at an elevation slightly above the plunger bore reduced diameter portion to provide horizontal planar walls 68. The bottom part of the front portion of the plunger bore is semicircular in vertical transverse cross section while from the circular part to walls 68 the sidewalls are vertical and parallel to one another to permit a primer 86 being moved into the front part of the plunger bore as will be described hereinafter. The depth of the front part of the plunger bore is slightly greater than the diameter of the primer to be seated in a cartridge case.

A primer tube groove 70 is provided in the jaw mount to open through the mount top surface and to the mount bore 65, the front part of the groove opening to jaw grooves 53, 54 and being of reduced transverse dimensions to provide spaced, vertical jaw mount lips 71. A primer tube 72 having a primer viewing slit 73 extending the length thereof has a lower end portion extended into groove 70 with its lower edge abutting against plunger mount walls 68 and slit 73 facing forwardly so that the lower part of the slit can be seen between lips 71.

A primer seater handler 77 is pivotally mounted on primer base P by a pivot 78 to have a downwardly projecting protions *77a* abut against the rear end of the plunger. The spring characteristics of spring 67 are such that the plunger is resiliently retained to hold the handle projecting upwardly and rearwardly and the front end of the plunger rearwardly of the primer tube chamber.

In using the second embodiment, the plunger mount M is adjusted to have its vertical front surface 81 retained coplanar with the plane of the inner walls of grooves 53–55. The jaws are positioned in the respective grooves with the set of lips appropriate for the cartridge cases to have primers seated therein adjacent mount bore 57, and the screws 58 extended through the jaw slots and loosely threaded in apertures 59. The handle is depressed (pivoted in the direction of the arrow 83) to move the plunger to extend forwardly of the inner walls of the grooves 53–55. With the handle depressed and the jaws spread apart, an unprimed case 84 is fitted over the front end of the punch to have the punch extend into the case primer pocket. The jaws are moved to have the appropriate set of lips extend into the cannelure 85 and abut against the case and the screws 58 hand tightened while the handle is depressed. The case is rotated to see if it rotates freely and if not, the jaw at the point of friction is adjusted. Then the screws are tightened by a wrench to lock the jaws in their adjusted positions. A few other cases can be positioned to be held by the jaws to see if they are properly adjusted.

Now the primer tube is filled with the primers with the adjacent circumferential surfaces in abutting relationship, the tube is moved into the groove 70. A paper clip may be used to hold the primers in the tube while the tube is pushed downwardly in the groove 70. Upon removing the clip, the lowest primer 86 will drop into the front part of the plunger mount bore.

Thereafter a cartridge case 84 is translated through the feed groove 54 to have the jaw lips extend into the case cannelure. Now the handle is depressed to move the plunger forwardly to push primer 86 into the primer pocket, the spring returning the plunger and handle to their datum positions of FIGS. 5, 6 upon releasing the handle.

The radius of curvature of the front part of the plunger mount is greater than that of the primer pocket but may be greater or less than that of the cartridge rim. Thus depending on the size of the cartridge case that is positioned to be primed, the case may or may not abut against the inner surfaces of grooves 53–55.

It is to be noted the height of groove 55 is sufficiently great the jaw 19 will still be above the surface on which the base is supported even when the top of its slot 20 abuts against the screw 58 that extends therethrough.

Even though the top surface of the jaw holder is described as being horizontal, it is to be understood that the first embodiment can be used when said surface extends vertically with groove 14 above groove 15. Further, even though the front surface of the second embodiment is shown as being vertical, the second embodiment of jaw mount can be used when said surface is a top horizontal surface. Thus, even though the use of the jaw holders have been described with reference to specific cartridge case reloading tools, it is to be understood they can be used with cartridge case reloading tools of other constructions.

What is claimed is:

1. Apparatus for holding a cartridge case having a cannelure during a cartridge case reloading operation comprising a jaw mount having an elongated linear first groove having an intermediate portion, a linear cartridge case feed second groove opening to the first groove intermediate portion, a linear third groove opening to the first groove intermediate portion opposite the opening of the second groove to the first groove and extending at right angles to the first groove, the first, second and third grooves in part being defined by jaw mount inner walls that are coplanar, and a bore opening through the first groove inner wall in centered relationship to the openings of the second and third grooves to the first groove and extending through the jaw mount, a first jaw and a second jaw mounted in the first groove for slidably movement on diametric opposite sides of the opening of the bore to the first groove, a third jaw slidably mounted in the third groove, each jaw having a slot elongated in a direction that extends radially relative the bore and a lip extendable into the cartridge case cannelure, and a screw for each jaw extended through the respective jaw slot and threaded into the jaw mount for retaining the respective jaw in the respective groove in fixed selected adjusted radial positions relative the bore.

2. The apparatus of claim 1 further characterized in that each jaw lip is in part defined by a jaw cut providing a planar jaw shoulder facing the respective groove inner wall and a planar wall extending from the shoulder toward the respective groove inner wall.

3. The apparatus of claim 1 further characterized in that each jaw has opposite ends, the one end of each jaw having the above mentioned lip, and the other end of each jaw having a second lip adapted for accommodating cartridge cases of different dimensions than its one lip.

4. The apparatus of claim 1 wherein the cartridge case has a primer pocket and is in combination with a loading press having a frame portion, means for holding a cartridge case primer mounted on said frame portion, and means mounted on the frame portion and mounting the jaw mount and moving the jaw mount relative the frame portion to have the primer holding means extend through said bore for moving a primer into the primer pocket.

5. The apparatus of claim 1 wherein the cartridge case has a primer pocket and in combination with a primer seater, the primer seater including a base having a front end portion that comprises said jaw mount, a plunger mount mounted in the jaw mount bore,said plunger mount have a plunger bore extending axially therethrough and having a portion adapted to receive a primer adjacent the opening of the jaw mount bore to the first groove, plunger means mounted in the plunger mount bore and resiliently urged to a retracted position and movable for moving a primer in said bore portion into the primer pocket of a cartridge case held by said jaws, means mounted by the jaw mount and opening to said bore portion for supplying primers to said bore portion, and handle means mounted on said base for moving the plunger means from its retracted position to push a primer into the primer pocket.

6. The apparatus of claim 5 further characterized in that the first groove is horizontally elongated and opens forwardly, that the third groove is vertically elongated and extends downwardly from the first groove, and that the second groove extends vertically upwardly relative the first groove.

7. The apparatus of claim 1 further characterized in that each of the screws has a head end bearing against the respective jaw surface opposite the inner wall of the slot in which the jaw is mounted to hold the jaw in a fixed position relative the jaw mount.

* * * * *